US008267553B2

(12) United States Patent
Liang et al.

(10) Patent No.: US 8,267,553 B2
(45) Date of Patent: Sep. 18, 2012

(54) LED ILLUMINANT MODULE FOR MEDICAL LUMINAIRES

(75) Inventors: Jyh-Wei Liang, Alexandria, VA (US); De-In Shaw, Hsinchu (TW); I-Hsiu Chan, Fengyuan (TW); Wei-Li Wu, Taichung (TW)

(73) Assignee: Amtai Medical Equipment, Inc., Raleigh, NC (US)

( * ) Notice: Subject to any disclaimer, the term of this patent is extended or adjusted under 35 U.S.C. 154(b) by 176 days.

(21) Appl. No.: 12/916,646

(22) Filed: Nov. 1, 2010

(65) Prior Publication Data

US 2012/0106163 A1 May 3, 2012

(51) Int. Cl.
*F21V 5/04* (2006.01)
*F21V 13/04* (2006.01)

(52) U.S. Cl. ..... 362/328; 362/308; 362/329

(58) Field of Classification Search ..... 362/296.01, 362/308, 309, 327–329; 257/98
See application file for complete search history.

(56) References Cited

U.S. PATENT DOCUMENTS

| | | | | |
|---|---|---|---|---|
| 6,755,556 | B2 * | 6/2004 | Gasquet et al. | 362/329 |
| 7,111,964 | B2 * | 9/2006 | Suehiro et al. | 362/328 |
| 7,270,454 | B2 * | 9/2007 | Amano | 362/522 |
| 7,748,872 | B2 * | 7/2010 | Holder et al. | 362/308 |
| 8,029,163 | B2 * | 10/2011 | Chen et al. | 362/308 |
| 2005/0201118 | A1 * | 9/2005 | Godo | 362/555 |
| 2006/0050526 | A1 * | 3/2006 | Ikeda et al. | 362/555 |
| 2006/0092644 | A1 * | 5/2006 | Mok et al. | 362/327 |

* cited by examiner

*Primary Examiner* — Alan Cariaso
(74) *Attorney, Agent, or Firm* — Leong C. Lei

(57) ABSTRACT

The LED illuminant module for medical luminaires contains a circuit board capable of heat dissipation, an LED die package, a beam splitter, and a reflector. The LED die package is attached to the circuit board and is covered by the beam splitter, which in turn is pressed by and positioned along with the reflector. Central beams from the LED die package are collimated by the beam splitter to project forward. The side light beams are refracted by the beam splitter, intercepted by the reflector, and directed to a target coverage area along with the central light beams. The illuminant module is able to achieve low energy consumption and ease of manufacturing simultaneously.

11 Claims, 4 Drawing Sheets

LED ILLUMINANT MODULE FOR MEDICAL LUMINAIRES

TECHNICAL FIELD OF THE INVENTION

The present invention generally relates to medical luminaires, and in particular to an illuminant module using an LED installed in a luminaire for medical diagnosis or treatment, where the illuminant module has a high color rendering index, and provides collimated projection, with low loss of light and high power efficiency.

DESCRIPTION OF THE PRIOR ART

Generally, luminaires for medical diagnosis or treatment, in addition to high intensity of illumination, should have a high color rendering index so as to visually distinguish between the tiny differences among tissues. Therefore, single-wavelength LED die packages cannot serve this purpose and only LED die packages with a high color rendering index and the full spectrum of visible light can be used. However, most LED die packages, due to the use of phosphor power, have a lighting efficiency of only about half that of single-wavelength LED die packages. As such, even though the LED die packages used for medical purpose have a life span of up to 30,000 hours, which is 30 times that of conventional halogen light bulbs, and the operational cost of the luminaires is therefore greatly reduced, the power conservation effect of the LED die packages still has plenty room for improvement. The power consumption of medical luminaires involves not only the luminaires themselves, but also the ventilation needed to remove heat from the luminaires. The latter is even more important than prolonging the life span of the illuminant.

Usually, in an operating room, each set of surgical luminaires has two light heads located between 30~40 cm above the surgeon's head, each consuming 120~150 watts. During an operation, if the air conditioning in the operating room is not cool enough, the heat produced from the light heads could interfere with the operation, especially if the surgeon wears sterile gloves and cannot wipe his or her sweat. This could cause infection or even death to the patient. As such, the temperature of an operating room is usually kept between 15~20 degrees centigrade, which is also important in order to slow bacteria growth as much as possible. As such, the cost of wasted energy is higher than the cost of replacing luminaires, and how to enhance the lighting efficiency of LED die packages is a major issue for medical luminaires.

As shown in FIG. 6, a conventional LED illuminant module has an LED die package 10 attached to a circuit board 40. Then, the light projection path of the LED die package 10 is covered by a lens 30 which splits the light beams from the LED die package 10 into those projecting to the center and those projecting to the sides, and directs them towards a target coverage area. Since light decays more as it traverses longer in a transparent material of high refractive index, two cylindrical holes 301 and 302 are provided on the lens 30 adjacent to the LED die package 10 and adjacent to the light emission plane of the lens 30, so as to reduce the light's traversal length within the lens 30. A total internal reflection surface A intercepts the side light beams and, by employing the total internal reflection as light enters a low density medium from a high density medium, directs the side light beams towards the target coverage area. As the total internal reflection surface A has to interface with the low-density air, positioning columns 303 (as indicated by the dashed lines in FIG. 6) cannot be present because they would interfere with the total internal reflection. Then, the lens 30 has to be accurately positioned and fixed by positioning element 50.

As described, the side light beams from the LED die package 10 would suffer significant losses. This is mainly due to the fact that the traversal distance through lens 30 of the side light beams are several times longer than that of the central light beams. Additionally, a portion of the side light beams intercepted by the total internal reflection surface A would be refracted out of the lens 30 and cannot be projected to the target coverage area. Conventionally, the light emission angle of LED die packages is about 140 degrees or greater. The light emission angle B of the front light beams, confined by the structure, usually cannot be greater than 60 degrees. As such, almost half of the light beams are side light beams and, when they decrease significantly, the lighting efficiency of a conventional illuminant is clearly reduced.

SUMMARY OF THE INVENTION

A major objective of the present invention is to provide an LED illuminant module which has a high color rendering index, collimated projection, and low loss of light energy so as to be used for medical lighting for diagnosis or treatment of patients, while achieving reduced power consumption.

A second objective of the present invention is to provide an LED illuminant module for medical diagnosis or treatment. The LED illuminant module contains a circuit board capable of heat dissipation, an LED die package, a beam splitter, and a reflector. The LED die package is attached to the circuit board and is covered by the beam splitter, which in turn is pressed by and positioned along with the reflector.

To achieve the foregoing objectives, instead of adopting the prior art's optical design which provides refraction in the center, and total internal reflection by the lateral sides, the present invention employs the thin-walled beam splitter to refract both the central and side light beams from the LED die package, so as to significantly reduce the side light beams' traversal distance within high density transparent material and thereby to lower energy loss. Then, the side light beams refracted by the beam splitter are intercepted by the reflector which has a high reflection rate, and are directed to the target coverage area. The beam splitter is embedded into the reflector for precise positioning and firmly fixed to the circuit board where the LED die package is installed. Since the light beams are intercepted and reflected by the highly reflective inner wall of the reflector, a number of positioning columns are configured around the outer circumference of the reflector by joining and locking with the circuit board for the positioning and fixation of the reflector and the beam splitter. The reflection angle of the side light beams is not affected by the positioning columns and therefore low energy consumption and ease of manufacturing are jointly achieved.

The foregoing objectives and summary provide only a brief introduction to the present invention. To fully appreciate these and other objects of the present invention as well as the invention itself, all of which will be apparent to those skilled in this field, the following detailed description of the invention and the claims should be read in conjunction with the accompanying drawings. Throughout the specifications and drawings, identical reference numerals refer to identical or similar parts.

Many other advantages and features of the present invention will become manifest to those skilled in this field, upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
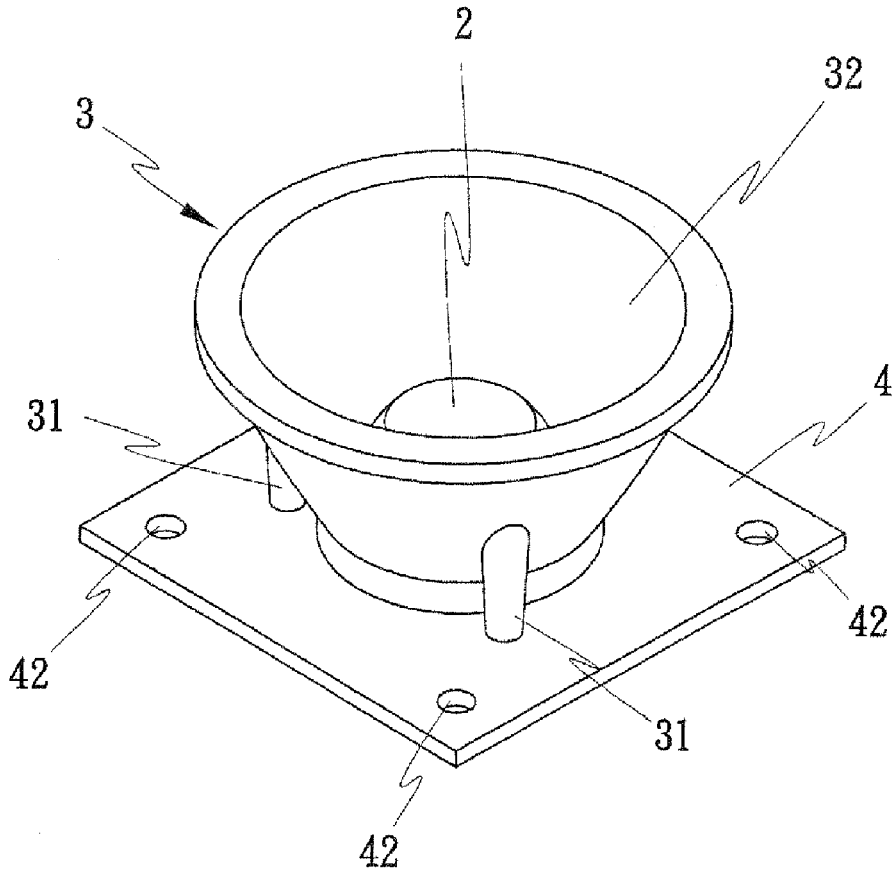
FIG. 1 is a perspective diagram showing an LED illuminant module according to one of the embodiments of the present invention.
Figure 2:
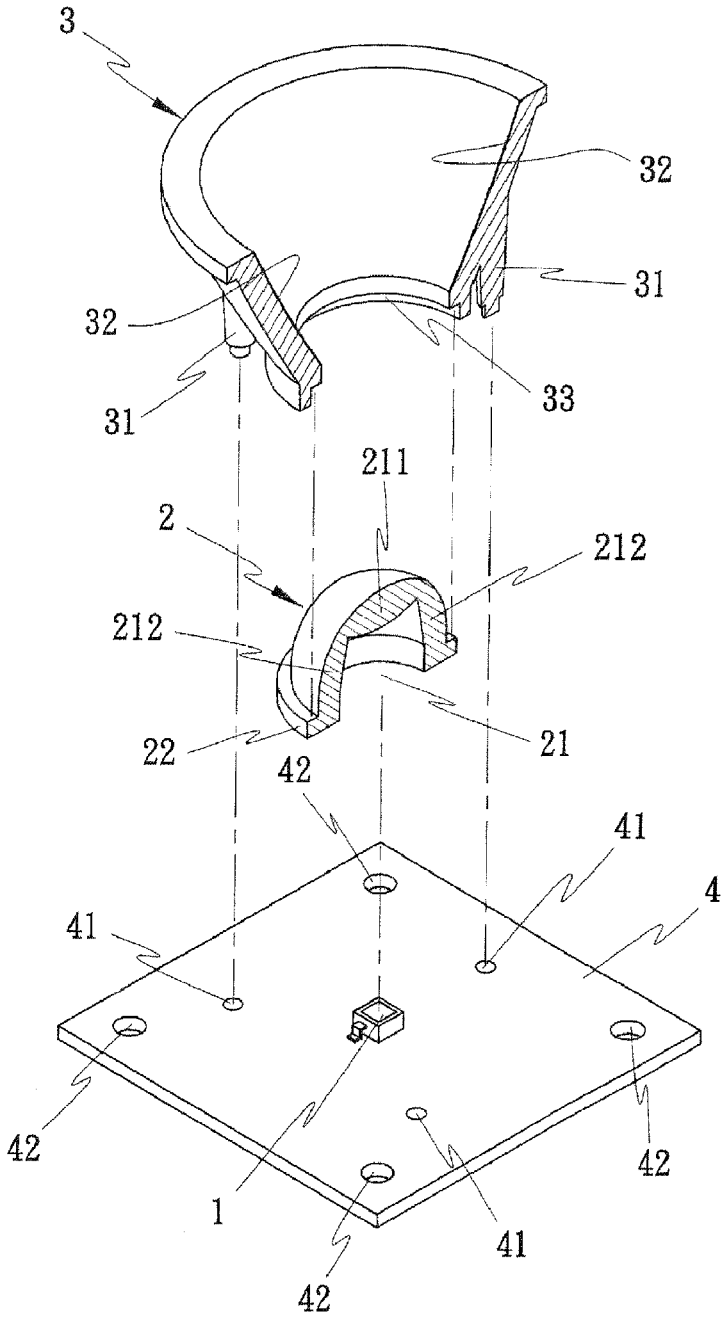
FIG. 2 is a perspective break-down diagram showing the various components of the LED illuminant module of FIG. 1.

As shown in FIGS. 1 and 2, an LED illuminant module according to an embodiment of the present invention mainly contains an LED die package 1, a beam splitter 2, a reflector 3, and a circuit board 4 capable of heat dissipation.

The LED die package 1 is of high color rendering property and of full visible light spectrum. Preferably, the LED die package has a color rendering index of at least 85, and a color temperature close to natural light, which is between 3,000K and 6,700K. One such LED die package is produced by Edison Opto Corporation (see http://www.edison-opto-.com.tw/01_led_products_detail.asp?sn=45). Made of a material of high transparency and of a high refractive index, the beam splitter 2, as illustrated in FIG. 2, is a bowl-shaped object with a cavity 21 surrounded by a flange 22 at its opening; a first lens 211 opposite to the opening of the cavity 21 as a base of the beam splitter 2. There is also an annular second lens 212 between the opening of the cavity 21 and the first lens 211, connecting them to form the beam splitter 2.

The reflector 3 is a funnel-shaped object with a number of positioning columns 31 around the circumference of the reflector 3. A reflection layer 32 is coated on an inner surface of the reflector 3. Around the end of the reflector 3 with a smaller aperture, a groove 33 is provided, whose shape and dimension match those of the flange 22 of the beam splitter 2.

The circuit board 4 is for the mounting of the LED die package 1 and is made of a material of high thermal conductivity coefficient such as aluminum alloy or ceramic. Around the LED die package 1, the circuit board 4 has a number of through holes 41 and 42 for positioning the reflector 3 and the circuit board 4 itself respectively.

Figure 3:
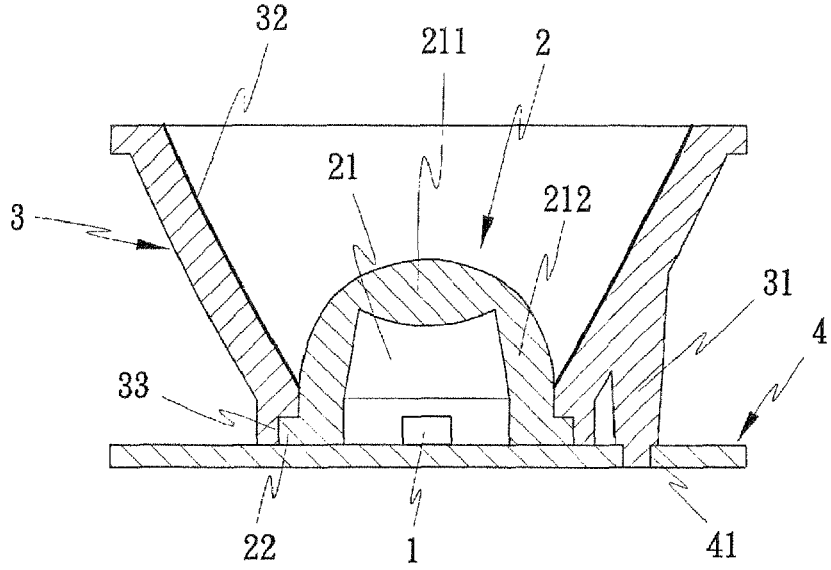
FIG. 3 is a sectional diagram showing the LED illuminant module of FIG. 1.

As shown in FIG. 3, the LED die package 1 is fixed at a specific location on the circuit board 4. The beam splitter 2 is then placed upside down on the circuit board 4, so that the LED die package 1 is completely inside the cavity 21 and the flange 22 is attached flatly to the circuit board 4. The reflector 3 is then placed on top of the beam splitter 2 and the flange 22 is completely accommodated by the groove 33. In the meantime, the positioning columns 31 are plugged into the through holes 41. For an LED illuminant module as described above, the light projected from the LED die package 1 towards the first lens 211 is directed and collimated outward. On the other hand, for the light projected from the LED die package 1 towards the annular second lens 212, it is refracted towards and thereby completely captured by the inner wall of the reflector 3. The reflection layer 32 there then directs the light outward.

For the through holes 42 on the circuit board 4, they help to position the circuit board 4 onto a medical luminaire and allow multiple circuit boards 4 to be arranged into an array so as to increase the overall intensity of illumination of the medical luminaire for better diagnosis or treatment.

Figure 4:
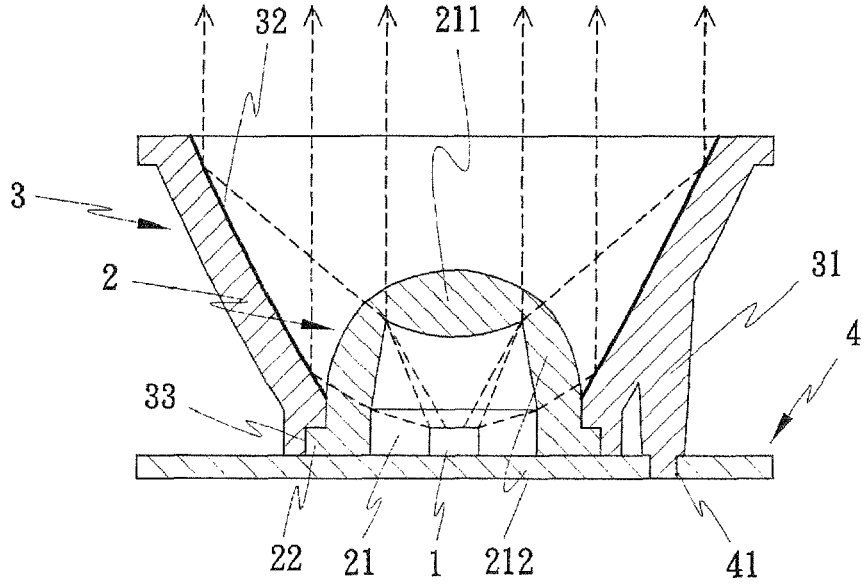
FIG. 4 is a sectional diagram showing the light trajectories of the LED illuminant module of FIG. 1.

Please note that the beam splitter 2 has a unique optical design in that the annular second lens 212 has a thin thickness. As such, not only the annular second lens 212 is able to direct light towards the reflector 3, as shown in FIG. 4, but also the light traverses only a limited distance within the beam splitter 2, thereby reducing the loss of light energy.

In addition, the reflector 3 is fixed to the circuit board 4 by the positioning columns 31. When the reflector 3 is positioned, the beam splitter 2 in the meantime is firmly settled between the circuit board 4 and the reflector 3. Furthermore, the positioning columns 31 are behind the reflection layer 32 of the reflector 3 and, as such, the positioning columns 31 do not interfere with the light processing by the beam splitter 2, thereby achieving reduced light energy loss and improved manufacturing simplicity.

Figure 5:
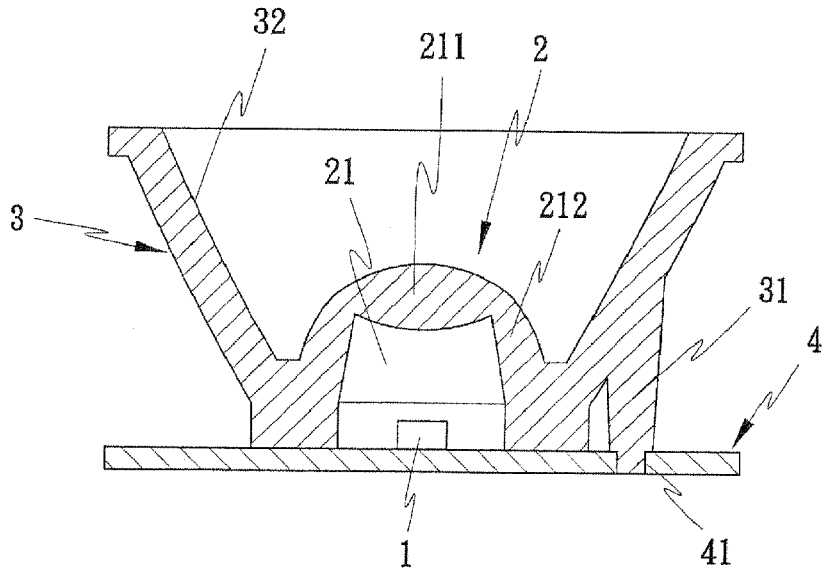
FIG. 5 is a sectional diagram showing an LED illuminant module according to another embodiment of the present invention.
Figure 6:
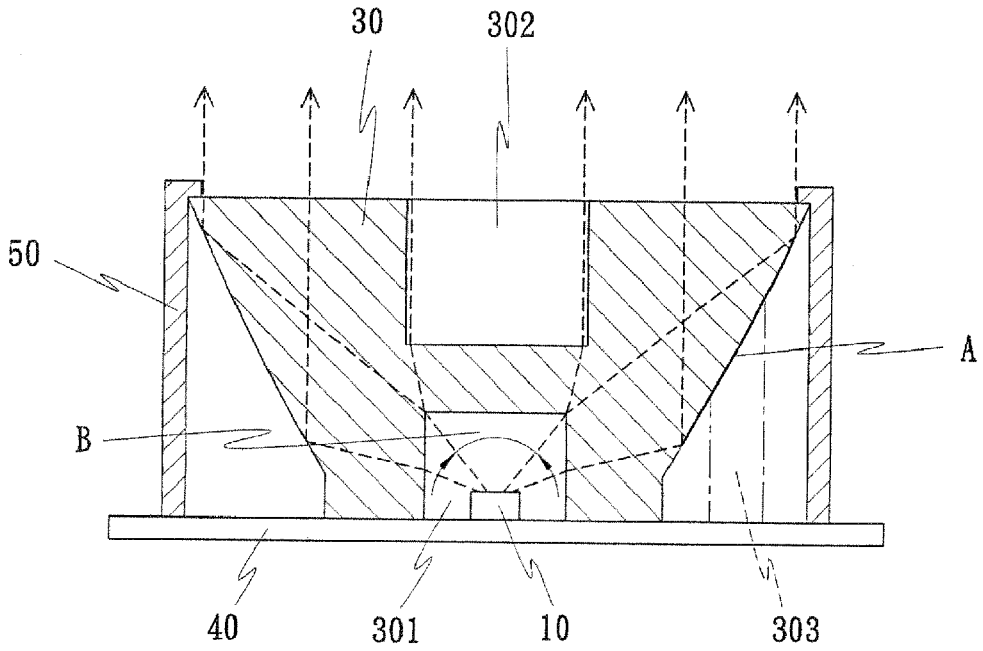
FIG.6 PRIOR ART
FIG. 6 is a sectional diagram showing the light trajectories of a conventional LED illuminant module.

As shown in FIG. 5, in an alternative embodiment, the beam splitter 2 and the reflector 3 could actually be jointly formed into an integral element.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. An LED illuminant module for medical lighting, comprised of:

a circuit board;

an LED die package fixed on said circuit board;

a beam splitter having a bowl-like shape with a cavity, with said beam splitter being comprised of a first lens opposite from the opening of said cavity, and an annular second lens between the opening of said cavity and said first lens, with the beam splitter being placed upside down on said circuit board so that said LED die package is covered by the beam splitter; and a reflector being placed on top of said beam splitter, with said reflector having a reflection layer on its inner surface;

wherein light projected from said LED die package towards said first lens is directed to project outward; and light projected from said LED die package towards said annular second lens is refracted towards and captured by the inner wall of said reflector so that it reflects outward.

2. The LED illuminant module according to claim 1, wherein several through holes are provided on said circuit board around said LED die package.

3. The LED illuminant module according to claim 2, wherein said reflector is fixed to said through holes of said circuit board; and said beam splitter is fixed by said reflector to said circuit board.

4. The LED illuminant module according to claim 1, wherein the opening of the cavity of said beam splitter is surrounded by a flange; a groove is provided around an end of said reflector adjacent to said circuit board; and said groove has a shape and dimension matching those of said flange.

5. The LED illuminant module according to claim 1, wherein said beam splitter is made of a material of high transparency.

6. The LED illuminant module according to claim 1, wherein plural positioning columns are provided around a circumference of said reflector.

7. The LED illuminant module according to claim 1, wherein said beam splitter and said reflector are jointly formed into an integral object.

8. The LED illuminant module according to claim 1, wherein said circuit board is made of a material of high thermal conductivity coefficient.

9. The LED illuminant module according to claim 8, wherein said material of high thermal conductivity coefficient is aluminum alloy.

10. The LED illuminant module according to claim 8, wherein said material of high thermal conductivity coefficient is a ceramic product.

11. The LED illuminant module according to claim 1, wherein said LED die package has a color rendering index of at least 85 and a color temperature between 3,000K and 6,700K.

* * * * *